US006263044B1

(12) United States Patent
Joosten

(10) Patent No.: US 6,263,044 B1
(45) Date of Patent: Jul. 17, 2001

(54) X-RAY EXAMINATION APPARATUS HAVING AN OBJECT ABSORPTION DEPENDENT BRIGHTNESS CONTROL

(75) Inventor: Johannes H. M. Joosten, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/455,665

(22) Filed: Dec. 7, 1999

(30) Foreign Application Priority Data

Dec. 8, 1998 (EP) ..... 98204175

(51) Int. Cl.[7] ..... H05G 1/64
(52) U.S. Cl. ..... 378/98.7; 378/95; 378/98.8
(58) Field of Search ..... 378/98.7, 98.8, 378/95, 62

(56) References Cited

U.S. PATENT DOCUMENTS

| | | | | |
|---|---|---|---|---|
| Re. 35,456 | * | 2/1997 | Yassa et al. | 378/98.7 |
| 5,602,896 | * | 2/1997 | Diepstraten | 378/98.7 |
| 5,664,000 | * | 9/1997 | Van Woezik et al. | 378/98.7 |
| 5,675,624 | * | 10/1997 | Relihan et al. | 378/98.7 |
| 5,710,801 | * | 1/1998 | Dillen et al. | 378/98.7 |
| 5,778,044 | * | 7/1998 | Bruijins | 378/98.7 |
| 5,923,724 | * | 7/1999 | Soukal | 378/98.7 |
| 6,175,614 | * | 1/2001 | Jensen et al. | 378/98.7 |

FOREIGN PATENT DOCUMENTS

0629105A1 12/1994 (EP) .

* cited by examiner

*Primary Examiner*—David V. Bruce
*Assistant Examiner*—Drew A. Dunn
(74) *Attorney, Agent, or Firm*—John F. Vodopia

(57) ABSTRACT

An X-ray examination apparatus for generating an X-ray image of an object, wherein X-ray image generator includes a brightness control input, image processor coupled to the X-ray image generator in order to output a brightness control signal to the control input. The X-ray image generator is provided with an X-ray data output, the image processor is provided with an X-ray data input coupled to the X-ray data output, and the image processor is arranged as calculating system for calculating absorption properties of the object and for generating the brightness control signal in dependence on the absorption properties. Intelligent measuring field selection is now possible on the basis of calculating absorption properties of identifiable objects or parts of objects reproduced in the visible image. Image quality is improved because of brightness control based on more intelligently selected measuring fields.

8 Claims, 1 Drawing Sheet

X-RAY EXAMINATION APPARATUS HAVING AN OBJECT ABSORPTION DEPENDENT BRIGHTNESS CONTROL

BACKGROUND OF THE INVENTION

1. Field of the Invention

The present invention relates to an X-ray examination apparatus which includes:

means for generating an X-ray image of an object, which X-ray image generating means have a brightness control input, and image processing means coupled to the X-ray image generating means in order to output a brightness control signal to said brightness control input.

The present invention also relates to a method for deriving a brightness control signal from information of an object in the X-ray image.

2. Description of Related Art

Such an apparatus and method are known from EP-A-0 629 105 which discloses in particular image processing means equipped with a light detection system wherein a CCD detector signal representing relative spatial intensity data of the X-ray image and a photodetector signal representing absolute intensity data of the X-ray image are multiplied so as to produce a desired brightness control signal. The known apparatus utilizes an image processor so as to define so-called measuring fields which contain selected image information which is relevant for basing the brightness control signal thereon. The measuring fields are selected either manually or automatically. In case of automatic selection of measuring fields, some intelligence is included in the image processor in order to select relevant pixels from registered pixels of the image.

Citation of a reference herein, or throughout this specification, is not to construed as an admission that such reference is prior art to the Applicant's invention of the invention subsequently claimed.

SUMMARY OF THE INVENTION

It is an object of the present invention to extend the field of application of the X-ray examination apparatus and to improve the image quality by offering additional possibilities for the selection of measuring fields in an X-ray image and for the identification of objects in the X-ray image.

To this end, the X-ray examination apparatus according to the present invention is characterized in that the X-ray image generating means are provided with an X-ray data output, that the image processing means are provided with an X-ray data input coupled to the X-ray data output, and that the image processing means are arranged as calculating means for calculating absorption properties of the object and for generating the brightness control signal in dependence on said absorption properties.

Similarly, the method according to the invention is characterized in that the information for deriving the brightness control signal results from the calculation of absorption properties of the object or parts thereof.

Selecting measuring fields on the basis of calculated absorption properties of the object reproduced in the X-ray image allows for a more intelligent measuring field selection, because parts of the objects which are relevant to the brightness control can now be identified by way of their absorption properties. For example, bones, organs, brains, pins, bolts and tissues, but also so called direct radiation can be intelligently identified automatically. Additionally, the brightness control signal can mainly be based on said identified object parts so as to optimize image quality, visibility and contrast of such parts in order to augment the possibilities of examination and analysis thereof. Advantageously, comparison of absolute brightness levels of specified objects, or parts thereof, on the basic of calculated absolute absorption figures is possible too, which is beneficial to the diagnoses to the made by a physician.

An embodiment of the X-ray examination apparatus according to the invention has the features that the object absorption calculating means are arranged as calculation means wherein the absorption of the object is calculated relative to the absorption rate of a reference substance. Calculations where the absorption rate is only related and calculated relative to a reference substance require only moderately complex and hence advantageously cheaper and faster operating calculation means. Furthermore, brightness control based on relative calculations does not necessitate laborious explicit calculations of absorption rates of object parts in the X-ray image.

From a medical point of view, water is a preferred reference substance in a further embodiment of the X-ray examination apparatus according to the invention. Generally speaking, the reference substance can be chosen from a group including: water, air, calcium, iodine, barium, iron or a synthetic material such as plastic.

A further embodiment yet of the X-ray examination apparatus according to the invention has the features that the object absorption calculating means include an application parameter input for inputting a signal which is representative of an absorption profile defining a contribution area wherefrom information is selectively taken in order to derive the brightness control signal therefrom. The application parameter input can advantageously be used for selecting a specific contribution area of interest in the X-ray image in dependence on, or example the kind of or combination of objects, such as bones, brains, lungs, tissues etc. to e imaged.

Another embodiment of the X-ray image apparatus according to the invention is equipped with Fuzzy Logic means for defining a Fuzzy Logic rule dependent contribution area. This improves the image quality of specific image parts whose absorption lies in said contribution area.

Still a further embodiment of the X-ray apparatus according to the invention has the features that the X-ray data output of the X-ray image generating means provides information about, for example a driving current and/or driving voltage applied to the X-ray image generating means, a distance between an X-ray source and an image intensifier in the X-ray image generating means, the image format of the image intensifier and/or other parameters such as application parameters which are considered relevant for the calculation of absorption. The aforementioned information and the inclusion of one or more parameters listed above determines the accuracy of the absorption calculations and the brightness control.

BRIEF DESCRIPTION OF THE DRAWING

The X-ray examination apparatus and the method according to the invention will be elucidated, together with their additional advantages, with reference to the appended drawing. In the drawing.

DETAILED DESCRIPTION OF THE PREFERRED EMBODIMENT

Figure 1:
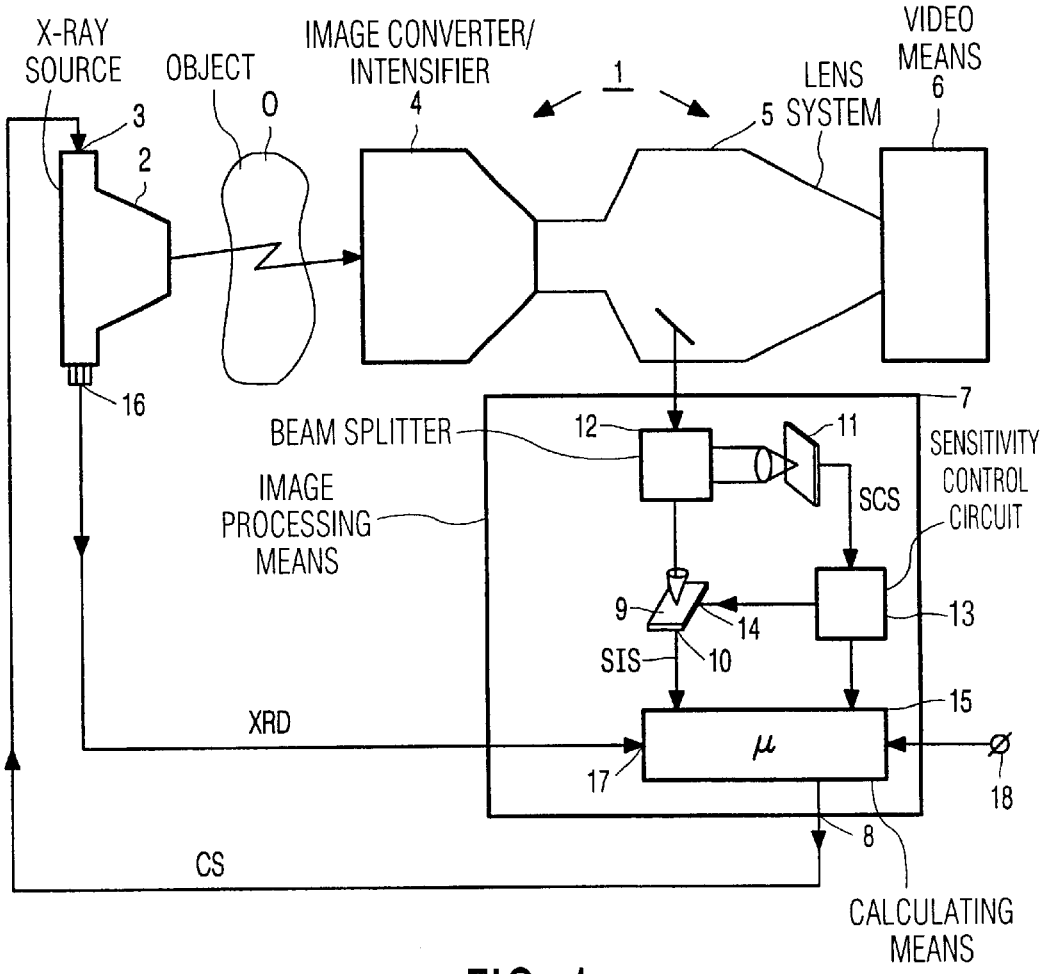
FIG. 1 shows a feasible embodiment of the apparatus according to the invention.

FIG. 1 shows schematically an X-ray apparatus 1 which includes X-ray image generating means formed as an X-ray source 2 with a brightness control input 3 for influencing the intensity of X-rays emanating from the X-ray source 2. The X-rays from the source 2 irradiate an object O to be examined, for example being a human or generally a body part, and form an X-ray image thereof on an image converter/intensifier 4 of the X-ray image generating means. The apparatus 1 also includes a schematically shown lens system 5 interposed between the image intensifier 4 and video means 6 which are provided, for example with a video camera or video recording means. The optical image formed in the lens system 5 is used to derive therefrom, via image processing means 7, a brightness control signal CS on a control output 8 which in its turn is coupled to the control input 3. Appropriate adjustment of the brightness of the acquired image is vital to a physician so as to allow high quality visual inspection of the part to be examined, generally with the aid of the video means 6. The X-ray examination apparatus 1 may be constructed as described in EP-A-0 629 105 which is considered to be included herein by way of reference.

The image processing means 7 schematically shown in FIG. 1 comprise a CCD detector 9 having a detector output 10 for providing relative spatial information, in the form of a spatial intensity signal SIS, about each pixel of the visual image, and also a photosensor 11, both elements being coupled to a beam splitter 12. The photosensor 11 provides absolute average intensity information, in the form of a sensitivity control signal SCS, about the image as a whole; this signal has adequate dynamic range. The means 7 are provided with a sensitivity control circuit 13 which in its turn is connected to a control input 14 of the CCD detector 9. Finally, a spatial information signal SIS with the required dynamic brightness range is fed from the CCD detector 9 to calculating means 15, usually being a suitably programmed microprocessor, for executing calculations (to be elucidated later) yielding the desired brightness control signal CS on the control output 8 and hence on the control input 3 of what was referred to earlier as the (combined) X-ray image generating means in particular the X-ray source 2. The X-ray image generating means is provided with an X-ray data output 16 which provides information (XRD) about, for example the electron emission determining cathode current applied to an X-ray tube in the source 2 and/or a high voltage applied to the source 2. This information may additionally contain data about an adjusted distance between the X-ray source 2 and the image intensifier 4 and/or the image format of the image intensifier 4 and/or other parameters such as application parameters considered relevant for selection of absorption ranges with absolute absorption rates. Conversely, the calculating means 15 are provided with an X-ray data input 17 coupled to the X-ray data output 16. Said calculations concern the calculation of the amount of absorption and/or absorption properties of the object O, or parts thereof, the brightness control signal CS being generated in dependence on said calculated absorption. The cathode current is representative of the intensity irradiated to the object whereas the spatial intensity signal SIS represents absolute spatial information after passage of the X-rays through the object O. The calculation yields information about the amount of absorption by the object. Because an absolute absorption, depending on the expected thickness of the object, is known in principle, identification of a superposition of, for example bones-tissue, brains-bones, lungs-tissue etc. is now possible in combination and, if the combination of those identified objects in the image is to be visualized in detail, a corresponding measuring area contributing to the absorption of the object can be selected. This offers the result that, if the brightness control is based on the measuring areas thus selected, the object in question is depicted with a high quality.

The absorption calculating means 15 possibly have an application parameter input 18 for inputting, for example a threshold signal which is representative of an absorption level defining the contribution area wherefrom the information is selectively taken in order to derive the brightness control signal therefrom. Instead of a threshold signal, a more complex signal can be input for example as a profile which may even be a fuzzified absorption rate profile as will be explained later on.

The absorption of objects in practice depends on the frequency spectrum of the X-rays in the beam, so that the high voltage of the X-ray source 2, representing information about said spectrum, can effectively be used for calculating a correction depending on said voltage. The air also absorbs X-rays, so that a distance between the X-ray source 2 and the image intensifier 4 can also be used as a correction in the calculations of the absorption of the object. The same holds for the image format of the image intensifier 4 and for other feasible parameters, such as application parameters which are considered relevant to the calculated absorption.

In order to simplify and accelerate the calculations performed in the calculation means 15 it is considered useful to determine the absorption of the object relative to the known absorption rate of a reference substance. Examples of such a reference substance are: water, air, calcium, iodine, barium, iron or a synthetic material such as plastic. Breaking down the absorption in an X-ray image to a selected reference substance allows for easy comparison and identification of, for example bones, tissue, blood or artificial objects in the X-ray image.

Figure 2:
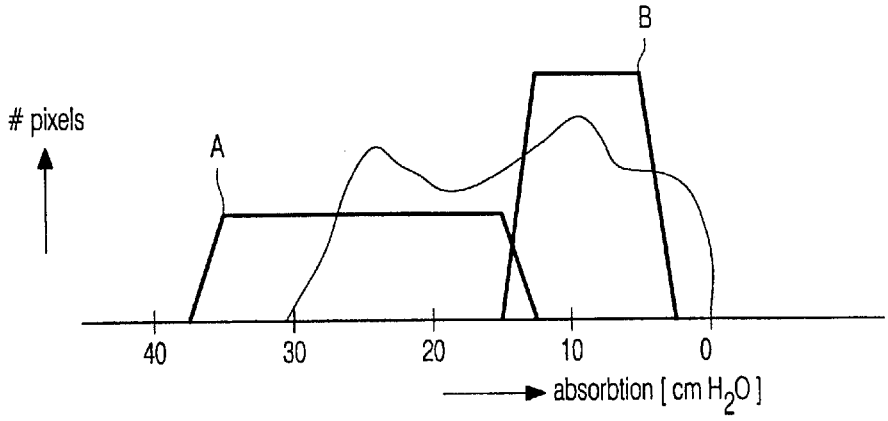
FIG. 2 shows a graph of the absorption of parts of objects depicted in an image.

The X-ray image apparatus 1, in particular the calculating means 15, is equipped with Fuzzy Logic means for defining a Fuzzy Logic rule dependent contribution area. The application of such an area is schematically depicted in FIG. 2 which shows a graph of the number of pixels as a function of the object absorption related to the absorption of water and in thick trapezium trapezoidal lines, the effects of defining Fuzzy sets so as to create respective contribution areas such as A and B, for example representative of given thicknesses of combinations of calcium plus tissue and tissue, respectively. Pixels within these trapezium trapezoidal curves provide information which may contribute to the brightness control to a desired extent. For example, pixels in area A add 20%, whereas pixels in area B add 60% to the brightness control so that, apart from tissue, also the tissue-bone interface can be properly examined while the bones themselves are less discernable in the X-ray image. Sharp transitions between selected areas are to be avoided as they jeopardize the stability of the brightness control.

All references cited herein, as well as the priority document European Patent Application 98204175.8 filed Dec. 8, 1998, are incorporated herein by reference in their entirety and for all purposes to the same extent as if each individual publication or patent or patent application was specifically and individually indicated to be incorporated by reference in its entirety for all purposes.

What is claimed is:

1. An X-ray examination apparatus comprising:

means for generating an X-ray image of an object, which X-ray image generating means have a brightness control input, and image processing means coupled to the X-ray image generating means in order to output a brightness control signal to said brightness control input, wherein the X-ray image generating means are provided with an X-ray data output, and the image processing means are provided with an X-ray data input coupled to the X-ray data output, and the image processing means are arranged as calculating means for calculating absorption properties of the object and for generating the brightness control signal in dependence on said absorption properties.

2. An X-ray examination apparatus as claimed in claim 1, wherein the object absorption calculating means are arranged as calculation means wherein the absorption of the object is calculated relative to the absorption rate of a reference substance.

3. An X-ray examination apparatus as claimed in claim 2, wherein the reference substance is chosen from a group including: water, air, calcium, iodine, barium, iron or a synthetic material such as plastic.

4. An X-ray examination apparatus as claimed in claim 1 wherein the object absorption calculating means include an application parameter input for inputting a signal which is representative of an absorption profile defining a contribution area wherefrom information is selectively taken in order to derive the brightness control signal therefrom.

5. An X-ray examination apparatus as claimed in claim 4 further comprising Fuzzy Logic means for defining a Fuzzy Logic rule dependent contribution area.

6. An X-ray examination apparatus as claimed claim 1 wherein the X-ray data output of the X-ray image generating means provides information about parameters which are relevant for the calculation of absorption properties of the object.

7. The apparatus of claim 6 wherein the parameters comprise a driving current and/or driving voltage applied to the X-ray image generating means, or a distance between an X-ray source and an image intensifier in the X-ray image generating means, or the image format of the image intensifier.

8. A method for deriving a brightness control signal for an x-ray image apparatus comprising:

forming an x-ray image of an object in the X-ray apparatus, and a step for deriving the brightness control signal from information resulting from the calculation of absorption properties of the object or parts thereof.

* * * * *